US011225083B2

(12) United States Patent
Kudo et al.

(10) Patent No.: US 11,225,083 B2
(45) Date of Patent: Jan. 18, 2022

(54) LEVER, LIQUID STORAGE APPARATUS, AND LIQUID EJECTING APPARATUS

(71) Applicant: SEIKO EPSON CORPORATION, Tokyo (JP)

(72) Inventors: Shoma Kudo, Shiojiri (JP); Naomi Kimura, Okaya (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/083,978

(22) Filed: Oct. 29, 2020

(65) Prior Publication Data

US 2021/0129546 A1 May 6, 2021

(30) Foreign Application Priority Data

Oct. 30, 2019 (JP) ..... JP2019-197251

(51) Int. Cl.
*B41J 2/175* (2006.01)

(52) U.S. Cl.
CPC ..... *B41J 2/1752* (2013.01); *B41J 2/17503* (2013.01); *B41J 2/17509* (2013.01); *B41J 2/17553* (2013.01); *B41J 2/17536* (2013.01)

(58) Field of Classification Search
CPC .. B41J 2/1752; B41J 2/17503; B41J 2/17509; B41J 2/17553; B41J 2/17536
See application file for complete search history.

(56) References Cited

U.S. PATENT DOCUMENTS

| | | | | |
|---|---|---|---|---|
| 6,293,662 | B1 | 9/2001 | Shihoh et al. | |
| 2002/0063759 | A1 | 5/2002 | Hirano et al. | |
| 2004/0090503 | A1 | 5/2004 | Kotaki et al. | |
| 2015/0298459 | A1* | 10/2015 | Yasumoto | H04N 1/10 347/86 |
| 2016/0207321 | A1 | 7/2016 | Osakabe | |
| 2017/0355197 | A1* | 12/2017 | Kudo | B41J 2/17513 |

FOREIGN PATENT DOCUMENTS

| | | | |
|---|---|---|---|
| JP | H11-198391 | A | 7/1999 |
| JP | 2000-334977 | A | 12/2000 |
| JP | 2001-105617 | A | 4/2001 |
| JP | 2016-132164 | A | 7/2016 |
| JP | 2019-123169 | A | 7/2019 |

* cited by examiner

*Primary Examiner* — Geoffrey S Mruk
(74) *Attorney, Agent, or Firm* — Oliff PLC

(57) ABSTRACT

A lever provided in a liquid storage apparatus that includes a liquid filling port, the lever including a first member that is pivotable relative to an apparatus body of the liquid storage apparatus, a second member that is pivotable relative to the first member, and a flexible sealing plug that seals the liquid filling port, the first member including a lever body on which the sealing plug is mounted, a first attaching portion provided on a first end of the lever body, the first attaching portion configured to pivotably engage with the apparatus body, and a second attaching portion provided on a second end of the lever body, the second attaching portion configured to pivotably engage with the second member.

12 Claims, 15 Drawing Sheets

LEVER, LIQUID STORAGE APPARATUS, AND LIQUID EJECTING APPARATUS

The present application is based on, and claims priority from JP Application Serial Number 2019-197251, filed Oct. 30, 2019, the disclosure of which is hereby incorporated by reference herein in its entirety.

BACKGROUND

1. Technical Field

The present disclosure relates to a technique of a lever provided in a liquid storage apparatus that includes a liquid filling port.

2. Related Art

Hitherto, in an ink jet printer including an ink tank, a technique including caps that seal ink filling ports of the ink tank is known (JP-A-2016-132164).

In the known technique, when the user fills ink into the ink tank, the cap is detached from the ink filling port. In such an instance, the ink may scatter around the ink filling port due to the impact when the cap is detached from the ink filling port. Such an issue is not limited to a cap that seals an ink filling port of an ink tank but is common to techniques that use a sealing plug to seal a liquid filling port of a liquid storage apparatus.

SUMMARY

According to a configuration of the present disclosure, a lever provided in a liquid storage apparatus that includes a liquid filling port is provided. The lever includes a first member that is pivotable relative to an apparatus body of the liquid storage apparatus, a second member that is pivotable relative to the first member, and a flexible sealing plug that seals the liquid filling port, the first member including a lever body on which the sealing plug is mounted, a first attaching portion provided on a first end of the lever body, the first attaching portion configured to pivotably engage with the apparatus body, and a second attaching portion provided on a second end of the lever body, the second attaching portion configured to pivotably engage with the second member.

DESCRIPTION OF EXEMPLARY EMBODIMENTS

A. First Exemplary Embodiment

Figure 1:
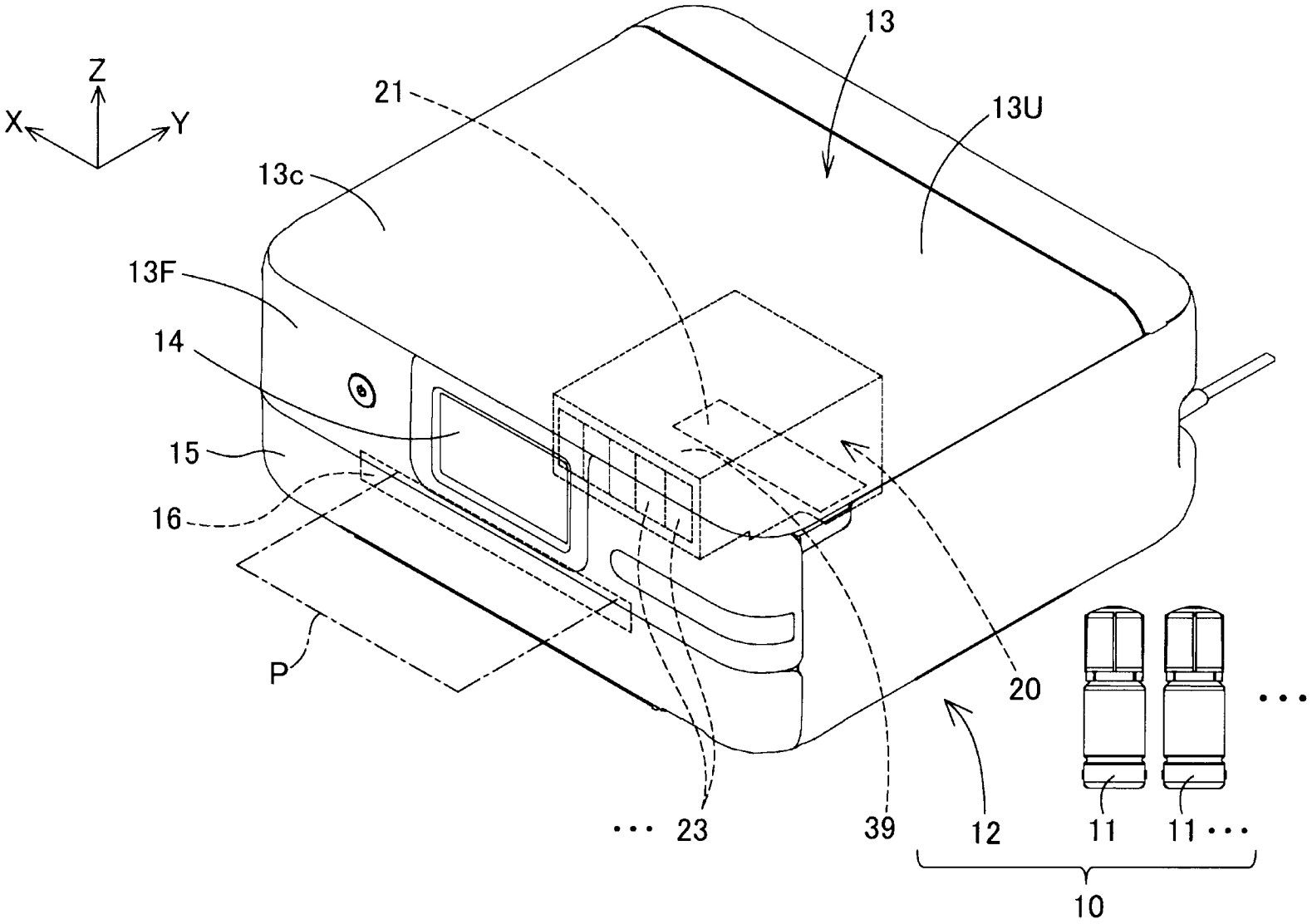
FIG. 1 is a schematic view illustrating a liquid ejecting system of a first exemplary embodiment.

FIG. 1 is a schematic view illustrating a liquid ejecting system 10 of a first exemplary embodiment. An X direction, a Y direction, and a Z direction that are orthogonal to each other are illustrated in FIG. 1. Note that the X direction, the Y direction, and the Z direction are, as required, also illustrated in the drawings other than FIG. 1 described hereinafter. The X direction, the Y direction, and the Z direction are directions associated with a position of a liquid ejecting apparatus 12 disposed on a horizontal surface. The X direction coincides with the left-right direction of the liquid ejecting apparatus 12 and is a direction parallel to the horizontal direction. In the X direction, the +X direction is, when facing the front side of the liquid ejecting apparatus 12, the left direction and the −X direction is the right direction. The +Y direction coincides with the front-rear direction of the liquid ejecting apparatus 12 and is a direction parallel to the horizontal direction. In the Y direction, the +Y direction is a direction extending from the front towards the rear and the −Y direction is a direction extending from the rear towards the front. The Z direction coincides with the up-down direction of the liquid ejecting apparatus 12 and is a direction parallel to the vertical direction. In the Z direction, the +Z direction is the upper direction and the −Z direction is the lower direction.

The liquid ejecting system 10 includes a plurality of liquid containers 11 in which liquids are stored, and the liquid ejecting apparatus 12 that ejects the liquids that the user has filled from the liquid containers 11.

The liquid ejecting apparatus 12 is an ink jet printer. The liquids stored in the liquid containers 11 are ink used for printing. The liquid ejecting apparatus 12 includes a liquid storage apparatus 39, and a carriage 20 on which a liquid ejecting head 21 is mounted. The liquid storage apparatus 39 includes a plurality of liquid storage containers 23, and an apparatus body 395 described later that houses the liquid storage containers 23. The plurality of liquid storage containers 23 store liquids of different colors. In the present exemplary embodiment, five liquid storage containers 23 are provided and are disposed so as to be arranged in the X direction.

The liquid ejecting head 21 is in communication with the plurality of liquid storage containers 23. The liquids stored in the plurality of liquid storage containers 23 flow through the liquid ejecting head 21. The liquid ejecting head 21 includes nozzles that eject the liquids onto a medium P. A printed image is formed on the medium P with the ejection of the liquids through the nozzles. When the liquid in the liquid storage container 23 is consumed and becomes exhausted or scarce, the user fills the liquid from the liquid container 11, which stores the corresponding type of liquid, to the liquid storage container 23 through a liquid filling port. Note that the plurality of liquid containers 11 each corresponds to one of the plurality of liquid storage containers 23 and each store the same liquid that is stored in the corresponding liquid storage container 23. In the first exemplary embodiment, the shapes and sizes of the plurality of liquid containers 11 are the same.

The liquid ejecting apparatus 12 further includes a hollow housing 13 having a rectangular parallelepiped shape. An interface portion 14 that displays information to the user and that receives operations from the user is provided in a front surface 13F of the housing 13. A front cover member 15 is attached below the interface portion 14 of the front surface 13F so as to be, about a fulcrum at a lower end of the front cover member 15, pivotable towards the front. By pivoting the front cover member 15 towards the front, a discharge opening 16 that discharges the medium P is exposed to the outside.

A body cover 13*c* included in the housing 13 constitutes an upper surface 13U of the housing 13 and an upper portion of the front surface 13F. The interface portion 14 described above is provided in the body cover 13*c*. The body cover 13*c* is opened and closed by being pivoted in the up-down direction with a hinge mechanism provided on the rear end side. The internal structure of the liquid ejecting apparatus 12 such as the liquid storage apparatus 39 is exposed by pivoting the body cover 13*c* upwards and opening the body cover 13*c*.

Figure 2:
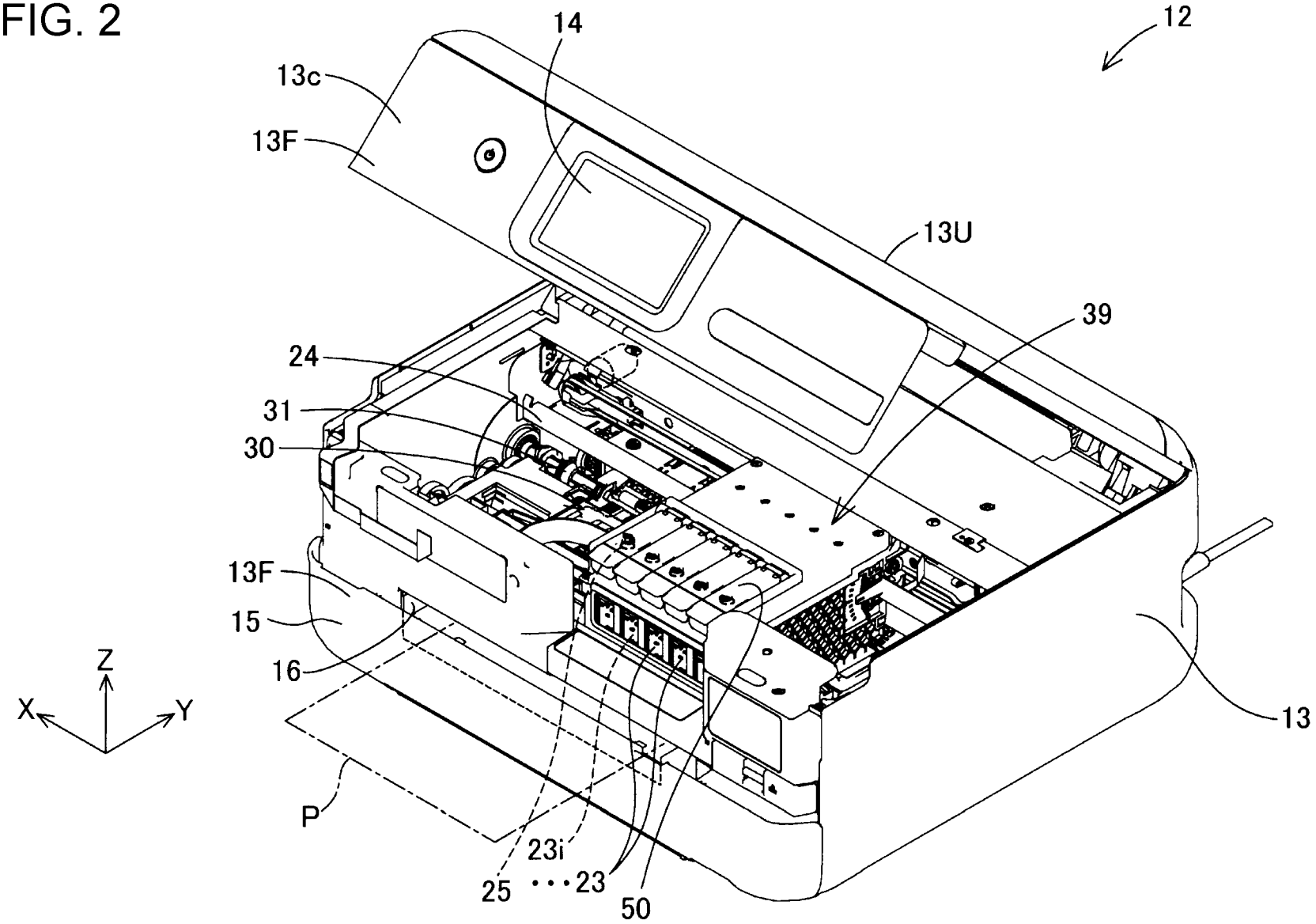
FIG. 2 is a schematic view of a liquid ejecting apparatus with the body cover open.

FIG. 2 is a schematic view of the liquid ejecting apparatus 12 with the body cover 13*c* open. Each liquid storage container 23 includes a storage portion 23*i* that stores the liquid, and a liquid filling port 25 through which the liquid is filled. The liquid filling port 25 is a cylindrical member in communication with the storage portion 23*i*. The liquid storage apparatus 39 further includes levers 50 that close the liquid filling ports 25. After the body cover 13*c* is opened, the user opens the lever 50 to expose the liquid filling port 25. After the liquid filling port 25 is exposed, the user fills the liquid into the liquid storage container 23 from the liquid container 11.

By being mounted on the carriage 20, the liquid storage apparatus 39 is supported by a guide shaft 24 so as to be reciprocated in the X direction. During a printing operation, the liquid storage apparatus 39 together with the carriage 20 is reciprocated along the guide shaft 24. Furthermore, during the printing operation, the medium P is transported in the −Y direction, which is a sub scanning direction, with a transport roller 31 in a transport path 30.

According to an operation of the user through the interface portion 14, the liquid ejecting apparatus 12 is set to a liquid filling mode. In the liquid filling mode, an execution of printing is prohibited, and the liquid storage apparatus 39 is moved to a preset position illustrated in FIG. 2. The above position is a position where portions of the liquid storage containers 23 can be visually confirmed by the user due to a cutout in a portion of a wall portion provided in front of the liquid storage apparatus 39. After setting the liquid ejecting apparatus 12 to the liquid filling mode, the user opens the lever 50 to expose the liquid filling port 25, which allows filling work of filling the liquid into the liquid storage container 23 from the liquid container 11 to be performed.

Figure 3:
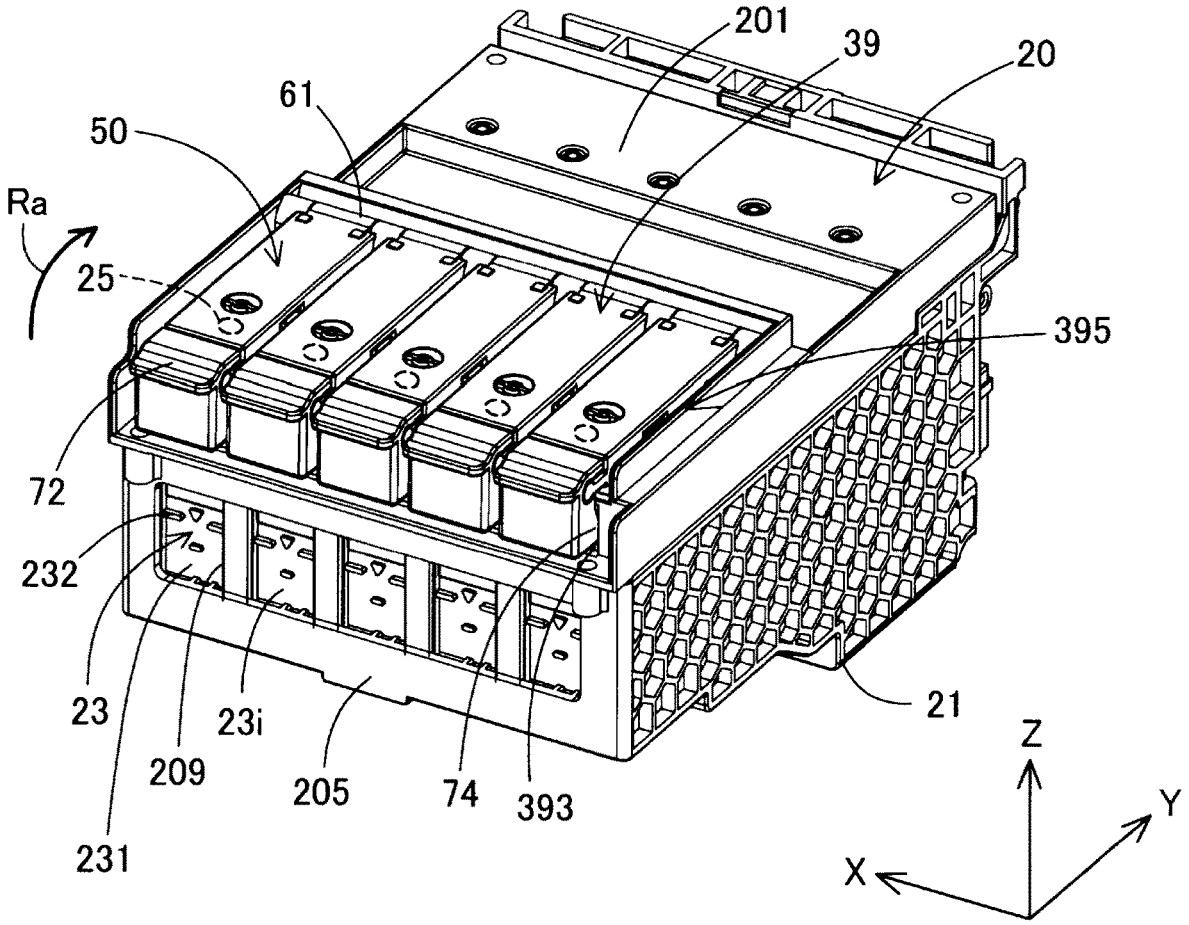
FIG. 3 is an external perspective view of a carriage on which the liquid storage apparatus is mounted.
Figure 4:
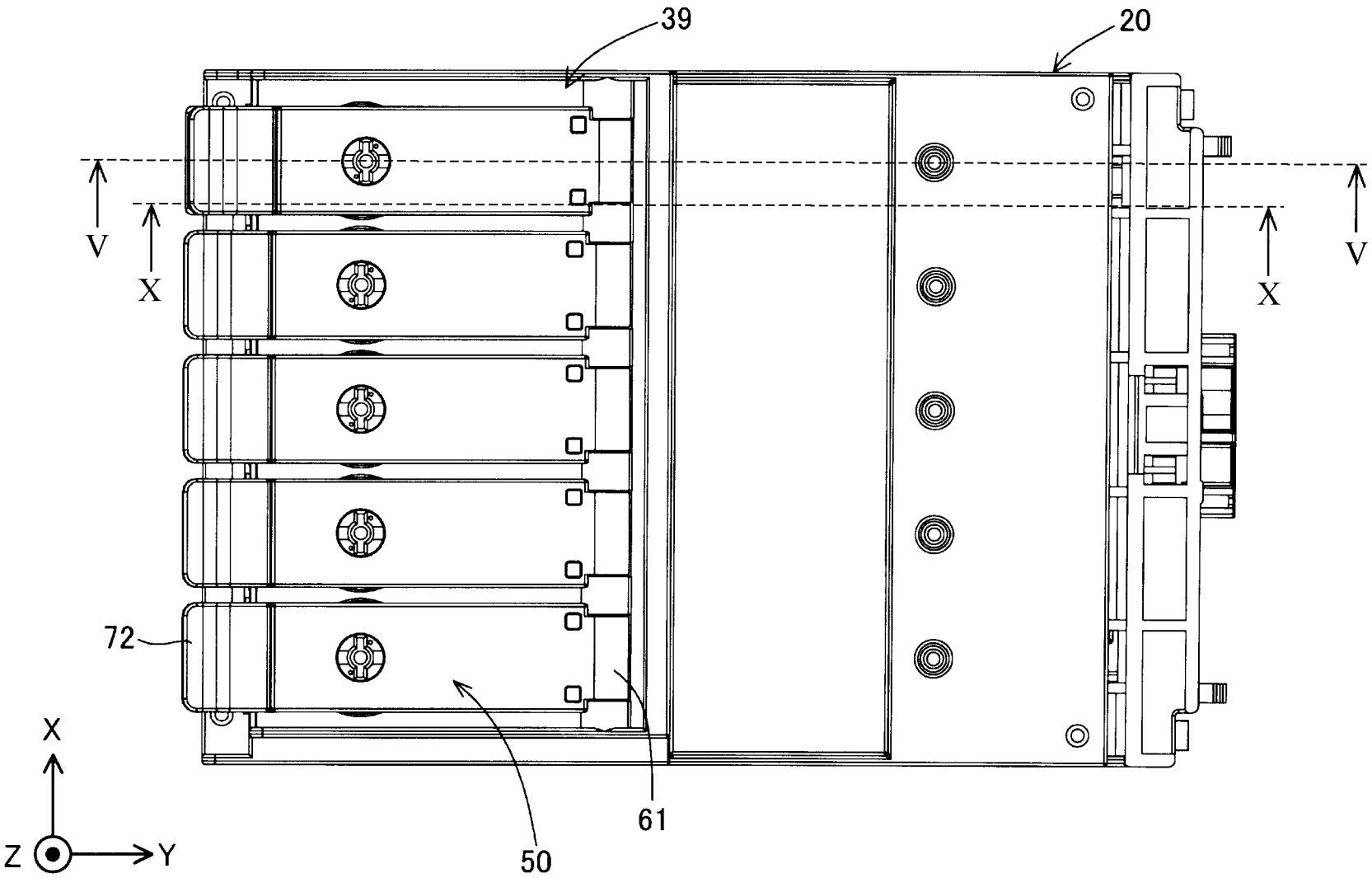
FIG. 4 is a top view of the carriage.

FIG. 3 is an external perspective view of the carriage 20 on which the liquid storage apparatus 39 is mounted. FIG. 4 is a top view of the carriage 20. The liquid storage containers 23 are housed in the liquid storage apparatus 39. The carriage 20 includes a front wall 205 positioned on the −Y direction side, and an upper wall 201 positioned on the +Z direction side. The front wall 205 includes openings 209. The front wall 205 also functions as a front wall of the liquid storage apparatus 39. The user can visually confirm walls 231, which separate and form storage portions 23*i*, through the openings 209. Each wall 231 includes an upper limit identification portion 232 for identifying the upper limit of the liquid that can be stored in the storage portion 23*i*. In the present exemplary embodiment, each upper limit identification portion 232 includes a mark that indicates the upper limit, and an upper limit line.

The levers 50 are pivotably attached to the apparatus body 395 of the liquid storage apparatus 39. The apparatus body 395 constitutes an outer shell of the liquid storage apparatus 39. The lever 50 is provided in a plural number so as to correspond to the liquid storage containers 23. The levers 50 are each a member that extends in the Y direction. Each lever 50 includes a holding portion 72 and engaged portions 74 formed in an end portion thereof on the −Y direction side, and a first attaching portion 61 that forms a pivoting fulcrum in an end portion thereof on the +Y direction side. The engaged portions 74 engaged with an engagement portion 393 formed in the front wall 205 maintain a closed state of the lever 50. With the above, the levers 50 can be prevented from being abruptly opened by vibration or the like of the carriage 20; accordingly, the closed state of the levers 50 can be maintained in a stable manner. The engagement portion 393 is a recessed portion in which the −Y direction side is open and that is depressed in the +Y direction.

When the lever 50 is in the closed state, the engaged portions 74 that have entered inside the recessed portion functioning as the engagement portion 393 engage with the engagement portion 393. Holding the holding portion 72 of the lever 50, the user pivots the lever 50 in an arrow Ra direction about the first attaching portion 61 serving as the fulcrum. The arrow Ra is the direction in which the lever 50 is opened. With the above, the engagement between the engaged portions 74 and the engagement portion 393 is canceled, which allows the lever 50 to be in an open state. When the lever 50 is in the open state, a sealing plug 80 becomes detached from the liquid filling port 25. With the above, the user can fill the liquid from the liquid container 11 through the liquid filling port 25.

Figure 5:
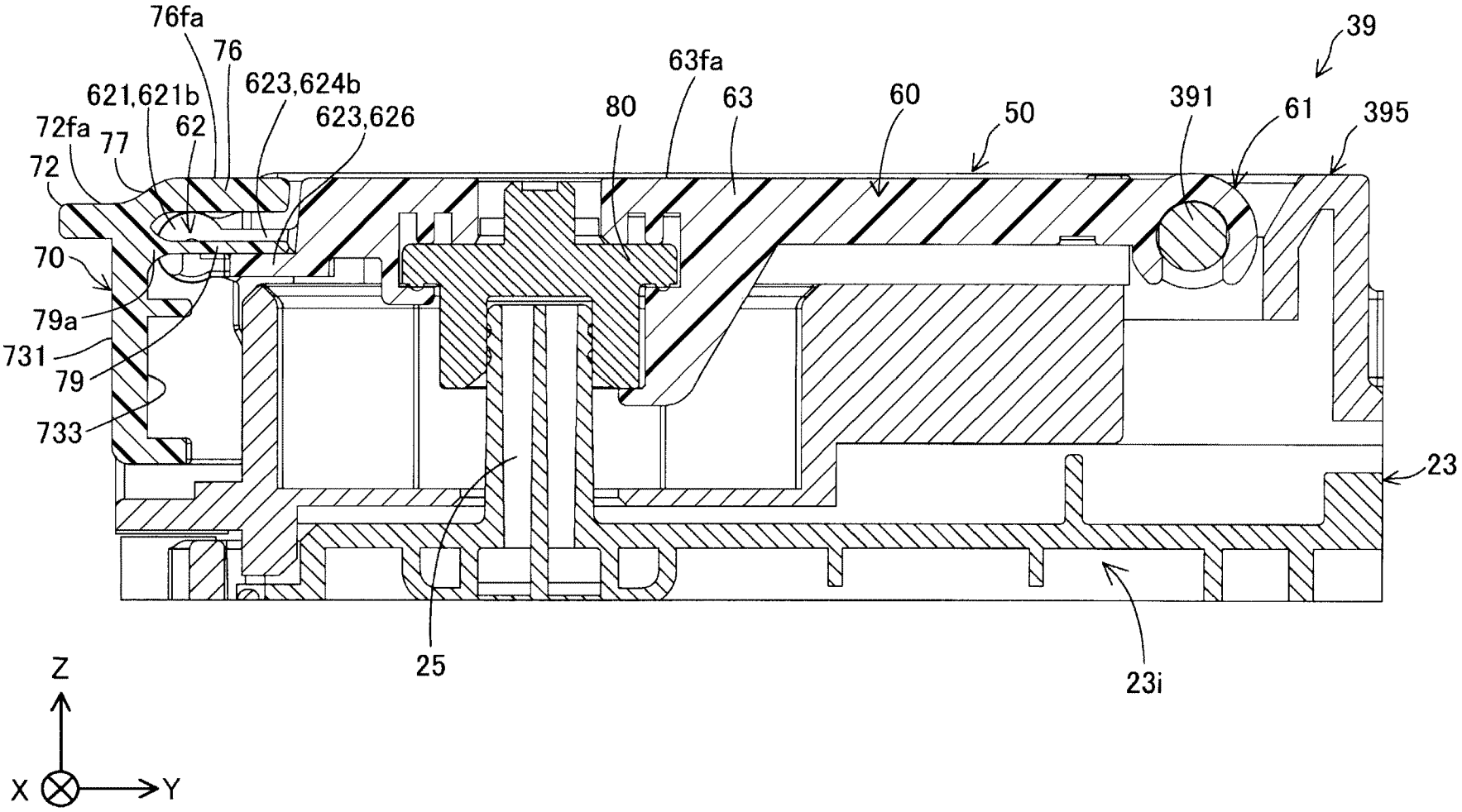
FIG. 5 is a partial cross-sectional view taken along line V-V in FIG. 4.
Figure 6:
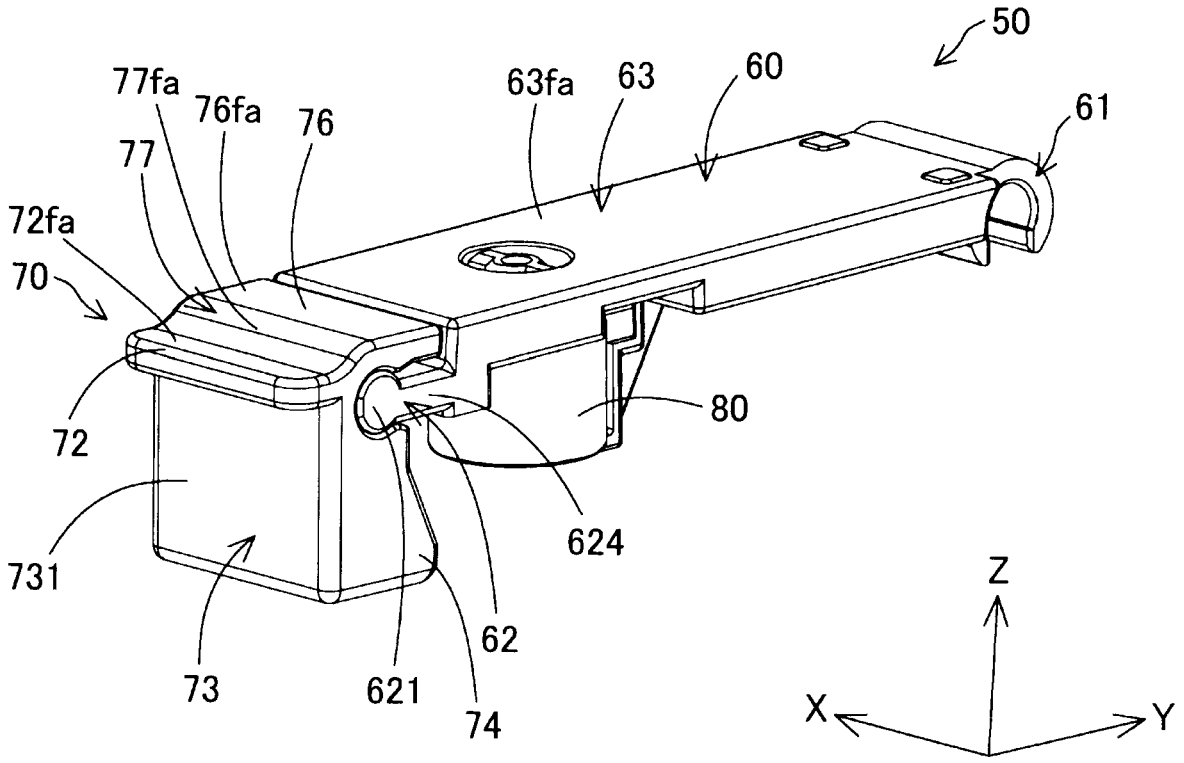
FIG. 6 is a perspective view of a lever.
Figure 7:
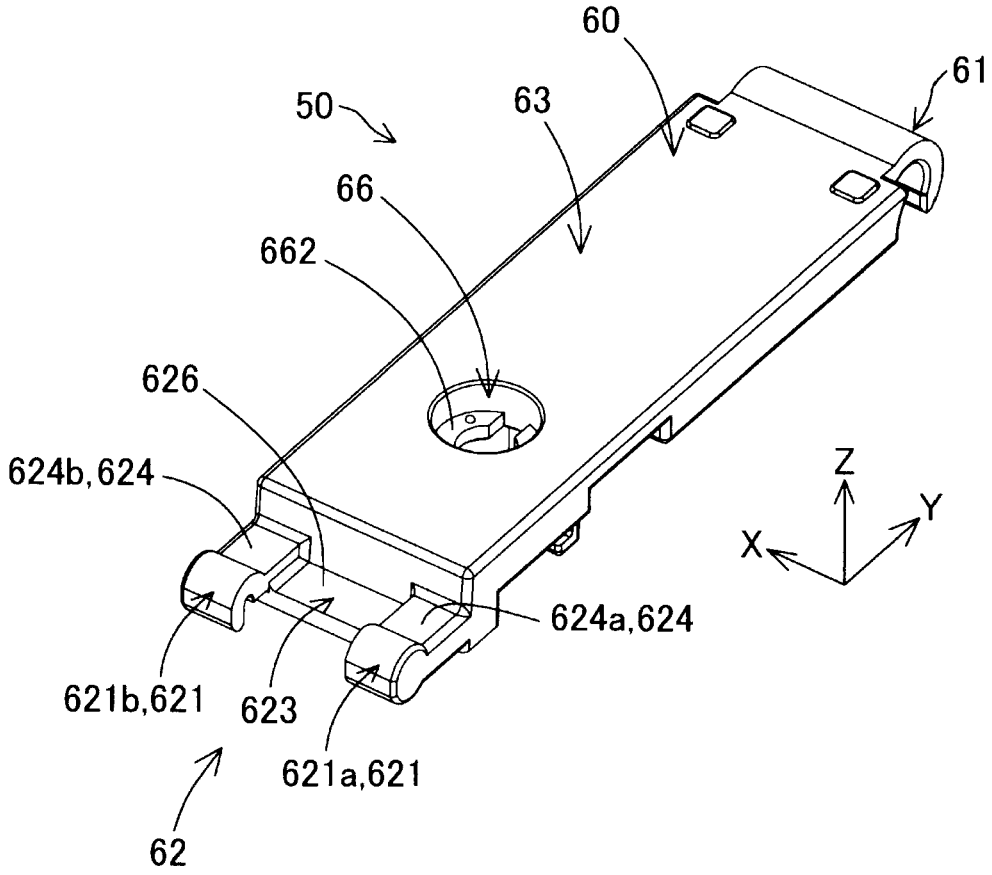
FIG. 7 is a perspective view of a first member of the lever.
Figure 8:
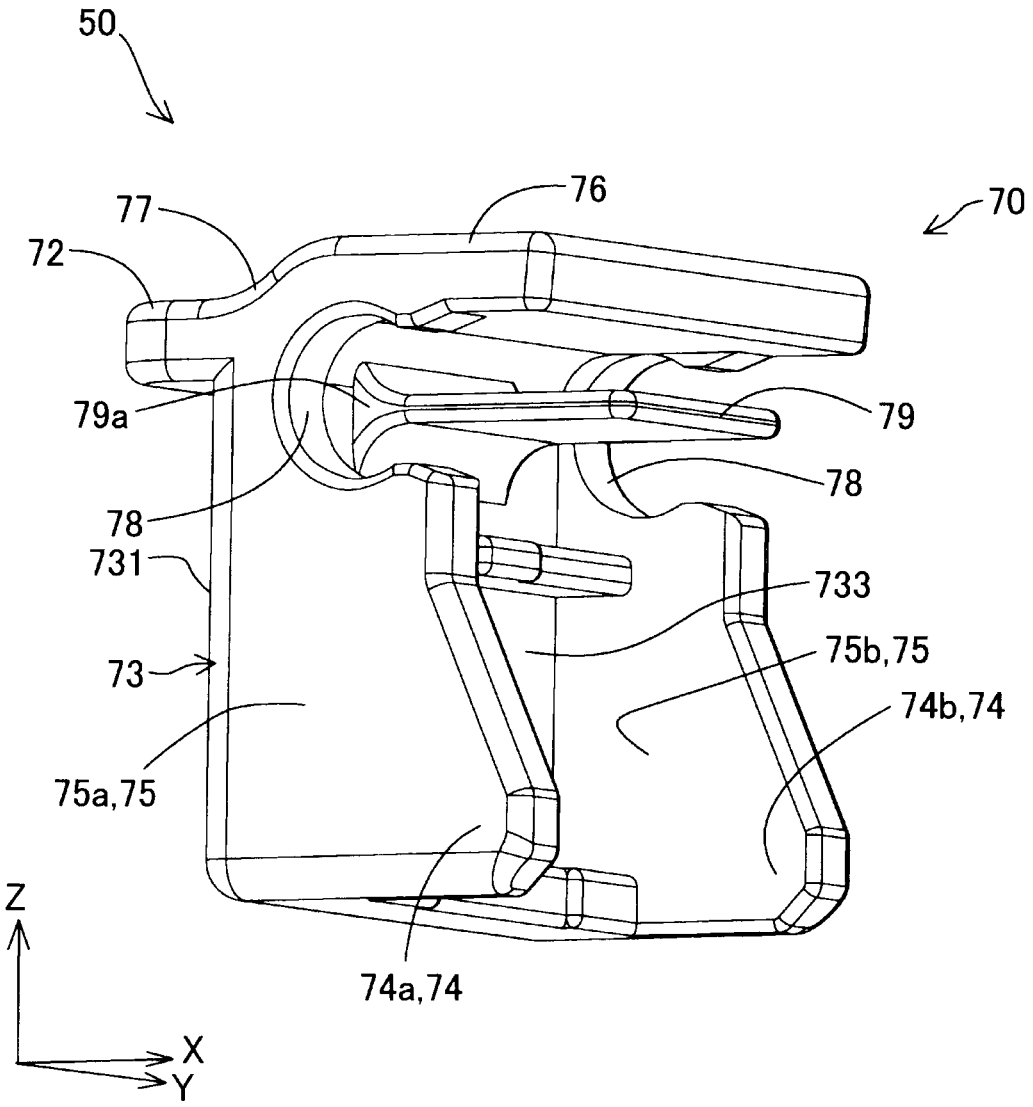
FIG. 8 is a perspective view of a second member of the lever.
Figure 9:
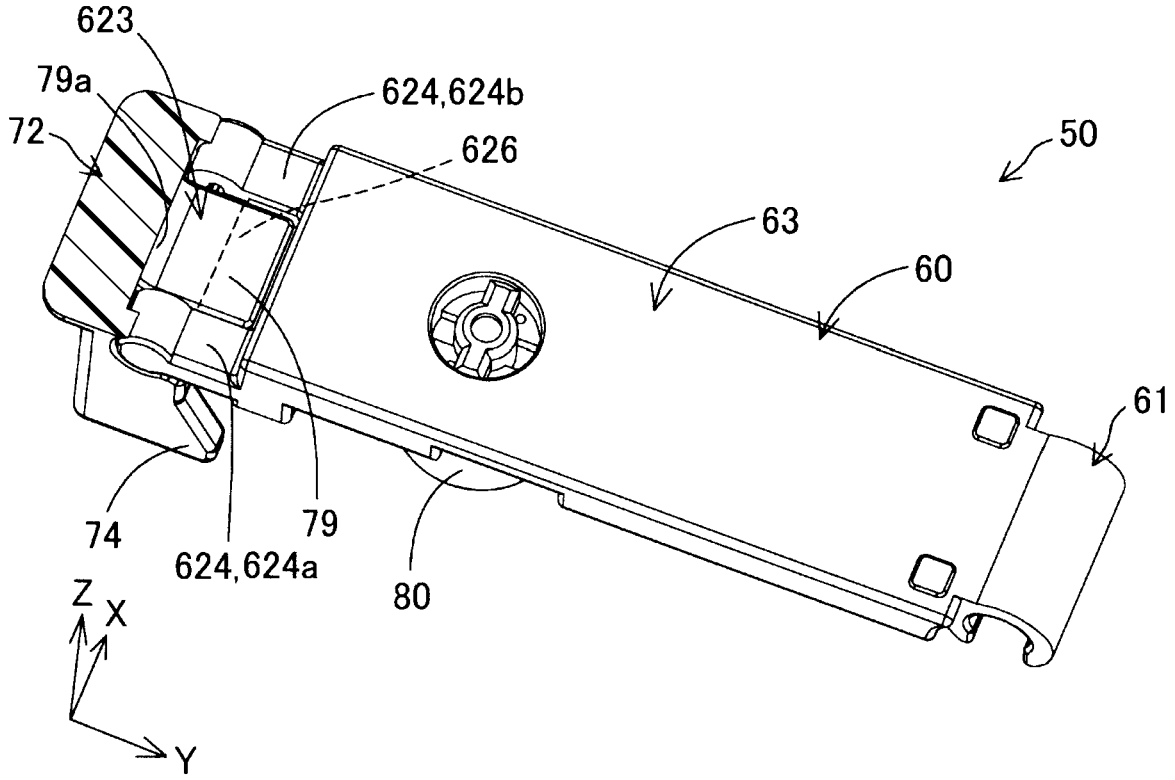
FIG. 9 is a partially cutaway view of the lever.

FIG. 5 is a partial cross-sectional view taken along line V-V in FIG. 4. FIG. 6 is a perspective view of the lever 50. FIG. 7 is a perspective view of a first member 60 of the lever 50. FIG. 8 is a perspective view of a second member 70 of the lever 50. FIG. 9 is a partially cutaway view of the lever 50. Note that in FIG. 5, a portion of the liquid storage apparatus 39 on the −Z direction side is omitted and only a portion around where the lever 50 is located is illustrated. Furthermore, an unloaded state in which external force is not applied to the lever 50, in other words, the closed state of the lever 50 is illustrated in FIG. 6.

As illustrated in FIG. 5, the apparatus body 395 further includes a columnar apparatus-side pivot shaft 391 that engages with the lever 50 and the second member described later in detail. The apparatus-side pivot shaft 391 is positioned in an end portion of the apparatus body 395 on the +Y direction side and in an end portion of the apparatus body 395 on the +Z direction side.

As illustrated in FIG. 6, the lever 50 includes the first member 60, the second member 70, and the sealing plug 80. The first member 60 is pivotable with respect to the apparatus body 395. The second member 70 is a member different from the first member 60 and is pivotably attached to the first member 60. The sealing plug 80 is flexible and, as illustrated in FIG. 5, seals the liquid filling port 25. The sealing plug 80 is formed of a flexible member such as an elastomer. The sealing plug 80 is a member that has a flexibly that is higher than those of the first member 60 and the second member 70.

As illustrated in FIG. 6, the first member 60 is a plate-like member that extends in the Y direction. The X direction is a width direction of the first member 60, the Y direction is a longitudinal direction of the first member 60, and the Z direction is a thickness direction of the first member 60. The first member 60 is formed of synthetic resin such as an ABS resin or a polystyrene resin.

The first member 60 includes a lever body 63 on which the sealing plug 80 is mounted, a first attaching portion 61 provided on a first end of the lever body 63 on the +Y direction side, and a second attaching portion 62 provided on a second end of the lever body 63 on the −Y direction side. As illustrated in FIG. 7, the lever body 63 includes a sealing plug disposing hole 66 that penetrates the lever body 63 in the Z direction, which is the thickness direction. A sealing plug mount portion 662 to which the sealing plug 80 is detachably mounted on the lever body 63 is formed in the sealing plug disposing hole 66.

The first attaching portion 61 is a member that protrudes from the lever body 63 in the +Y direction. As illustrated in FIG. 5, the first attaching portion 61 pivotably engages with the columnar apparatus-side pivot shaft 391 of the apparatus body 395.

As illustrated in FIG. 7, the second attaching portion 62 is a member that protrudes in the −Y direction from the lever body 63. The second attaching portion 62 includes a lever-side pivot shaft 621 with which the second member 70 pivotably engages, and a coupling portion 623 that couples the lever-side pivot shaft 621 and the lever body 63 to each other. The lever-side pivot shaft 621 includes a first-side rotation shaft 621*a* positioned on a first side in the X direction, and a second-side rotation shaft 621*b* positioned on a second side in the X direction. The first-side rotation shaft 621*a* and the second-side rotation shaft 621*b* are disposed with a gap in between in the X direction. A curved surface, specifically, a curved surface forming an arc that pivotably engages with the second member 70 is formed on the surface of each of the first-side rotation shaft 621*a* and the second-side rotation shaft 621*b*.

The coupling portion 623 is a plate-like member that protrudes from the lever body 63 in the −Y direction. The coupling portion 623 includes a coupling body portion 624 that couples the lever body 63 and the lever-side pivot shaft 621 to each other, and a pedestal portion 626. A thickness of the coupling body portion 624 is larger than that of the pedestal portion 626. The coupling body portion 624 includes portions positioned on the +Z direction side with respect to the pedestal portion 626. The coupling body portion 624 includes a first-side coupling body portion 624*a* that couples the lever body 63 and the first-side rotation shaft 621*a* to each other, and a second-side coupling body portion 624*b* that couples the lever body 63 and the second-side rotation shaft 621*b* to each other. The first-side coupling body portion 624*a* and the second-side coupling body portion 624*b* are disposed with a gap in between in the X direction. The pedestal portion 626 is a plate-like member and couples the first-side coupling body portion 624*a* and the second-side coupling body portion 624*b* to each other.

As illustrated in FIG. 8, the second member 70 includes a member body 73, the holding portion 72, an abutting portion 76, an inclined portion 77, an elastic portion 79, the engaged portions 74, and pivoted and engaged portions 78. The second member 70 is formed of synthetic resin such as polyacetal or an ABS resin. A color of at least a portion of the second member 70 and the color of the liquid stored in the corresponding liquid storage container 23 may be the same. For example, a color of the holding portion 72 of the second member 70 and the color of the liquid stored in the corresponding liquid storage container 23 may be the same. With the above, the user will be able to easily distinguish the color of the liquid stored in the liquid storage container 23 to which the liquid is to be filled. Note that in the present exemplary embodiment, the colors being the same means that the hue difference is from 0 to 3 in the 20 hue circle adopted in the Japanese Industrial Standard "JIS Z 8102".

The pivoted and engaged portions 78 each have an arc-shaped inner circumferential surface and pivotably engage with the lever-side pivot shaft 621. Two pivoted and engaged portions 78 are provided so as to correspond to the two lever-side pivot shafts 621*a* and 621*b*.

The member body 73 forms a principal surface 731 on the −Y direction side. The principal surface 731 is a flat surface that faces the −Y direction side. The holding portion 72 is held when the user performs an operation such as opening and closing the lever 50. The holding portion 72 is a plate-like member that protrudes in the −Y direction from an end portion of the principal surface 731 in the +Z direction.

As illustrated in FIG. 6, the inclined portion 77 couples the holding portion 72 and the abutting portion 76 to each other. The holding portion 72 and the abutting portion 76 are disposed at different height positions in the Z direction. Specifically, the holding upper surface 72*fa* of the holding portion 72 and the upper surface 76*fa* of the abutting portion 76 are disposed at different height positions in the Z direction. When the lever 50 is in the unloaded state, the holding upper surface 72*fa* and the upper surface 76*fa* are surfaces that are parallel to the X direction and the Y direction. The inclined portion 77 forms an inclination with respect to the holding upper surface 72*fa* and the upper surface 76*fa*, and couples the holding portion 72 and the abutting portion 76 to each other. Specifically, an inclined upper surface 77*fa* of the inclined portion 77 is inclined against the Y direction. More specifically, the inclined upper surface 77*fa* is inclined so that as the inclined upper surface 77*fa* extends towards the holding portion 72 from the abutting portion 76, the inclined upper surface 77*fa* is positioned more on the −Z direction side. By having the lever 50 include the inclined portion 77 in the above manner, compared to when the lever 50 does not include the inclined portion 77, the adhesion between a finger of the user, and the holding portion 72 and the inclined portion 77 can be increased when the user holds the inclined portion 77 together with the holding portion 72. In other words, it will be easier for the user to hold the holding portion 72.

As illustrated in FIG. 5, the abutting portion 76 is provided at a position overlapping the coupling portion 623 so as to oppose the coupling portion 623 in the Z direction. The abutting portion 76 is a plate-like member that protrudes in the +Y direction from an end portion of the principal surface 731 in the +Z direction with the inclined portion 77 in between. As illustrated in FIGS. 6 and 7, when the lever 50 is in the unloaded state and is in the closed state, the upper surface 76*fa*, which is a surface of the abutting portion 76 on a side opposite the side on which the coupling portion 623 is positioned, and the upper surface 63*fa*, which is a surface of the lever body 63 on a side opposite the side on which the sealing plug 80 is positioned, are located on the same plane. With the above, occurrence of unevenness in the entire lever 50 can be reduced. When the second member 70 is, relative to the first member 60, pivoted about the lever-side pivot shaft 621 serving as a fulcrum, the abutting portion 76 abuts against the coupling portion 623, for example, the coupling body portion 624, and restricts the pivoting range of the second member 70 to a fixed range.

As illustrated in FIG. 8, the elastic portion 79 is a flat spring that protrudes from a surface 733, which is a surface opposite the principal surface 731, towards the +Y direction side, or the side on which the lever body 63 is positioned. A thickness of the elastic portion 79 is smaller than that of the abutting portion 76. The elastic portion 79 is configured to become elastically deformed. As illustrated in FIGS. 5 and 9, the elastic portion 79 is disposed so as to be in contact with the pedestal portion 626 of the coupling portion 623. When the second member 70 is pivoted relative to the first member 60, the elastic portion 79 having external force applied thereto from the coupling portion 623 becomes elastically deformed. Specifically, as illustrated in FIG. 5, the elastic portion 79 becomes elastically deformed while having a base end portion 79*a* of the elastic portion 79 coupled to the surface 733 serve as a fulcrum.

Figure 10:
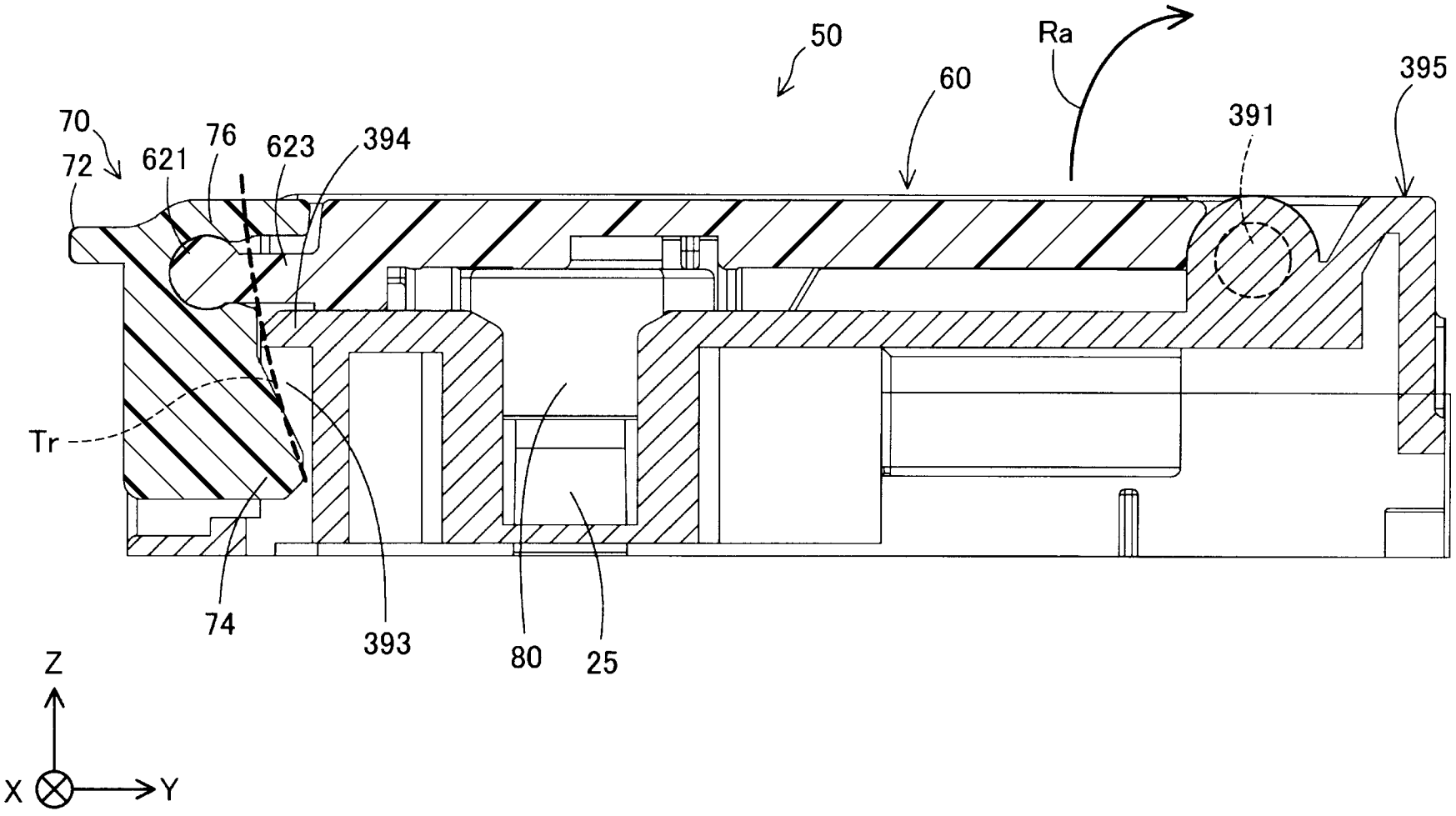
FIG. 10 is a first diagram for illustrating an opening/closing operation of the lever.

As illustrated in FIG. 10, when the lever 50 is in the closed state, the engaged portions 74 engage with the engagement portion 393 by entering the engagement portion 393, which is a recessed portion of the apparatus body 395. The engaged portions 74 are formed by portions of lateral walls 75 that protrude in the −Y direction from both end portions of the principal surface 731 in the X direction. The lateral walls 75 include a first lateral wall 75*a* on the −X direction side, and a second lateral wall 75*b* on the +X direction side. A distal end portion of the first lateral wall 75*a* on the +Y direction side forms a first engaged portion 74*a*. A distal end portion of the second lateral wall 75*b* on the +Y direction side forms a second engaged portion 74*b*. The first engaged portion 74*a* and the second engaged portion 74*b* constitute the engaged portions 74.

Figure 11:
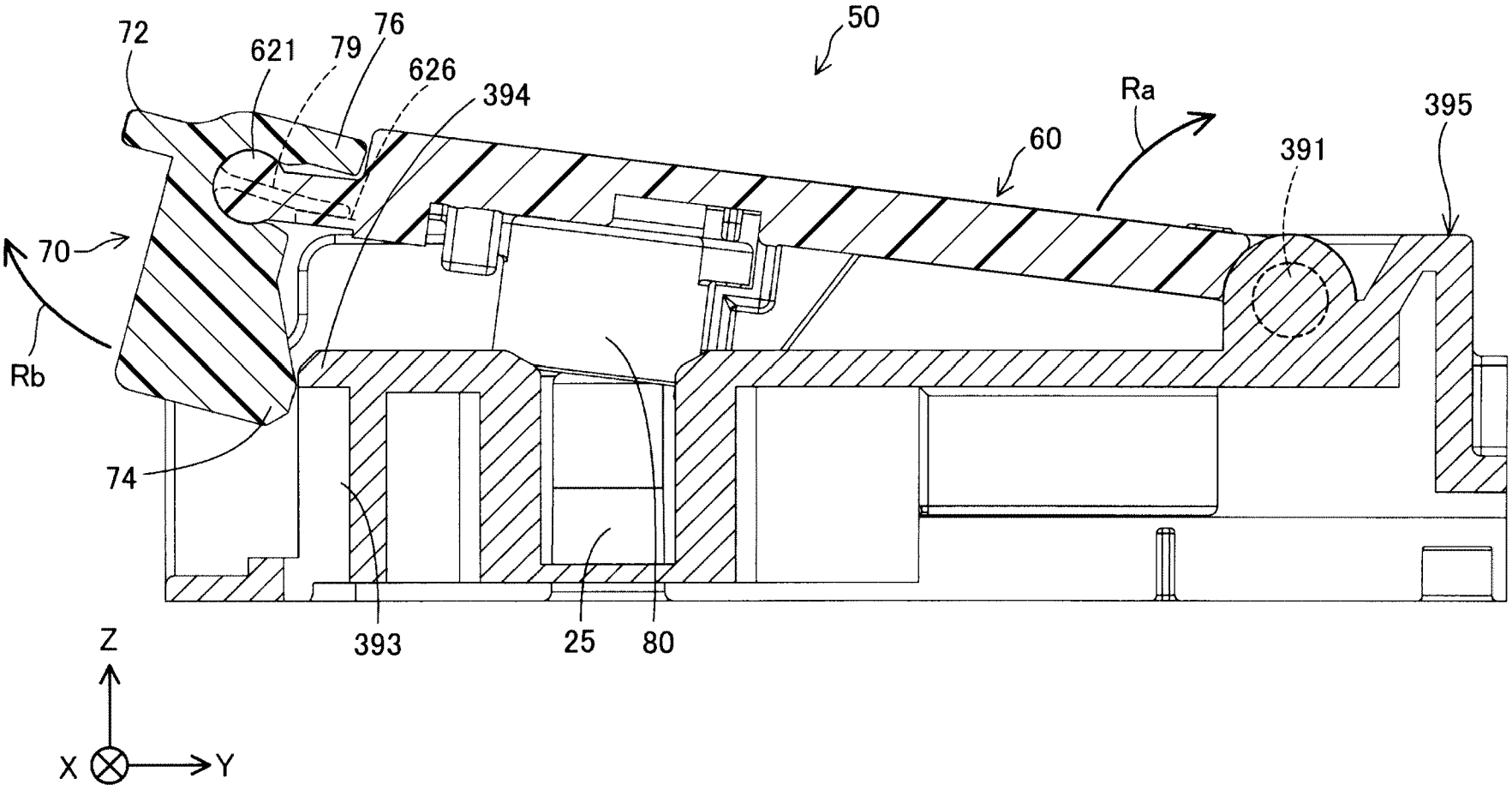
FIG. 11 is a second diagram for illustrating the opening/closing operation of the lever.
Figure 12:
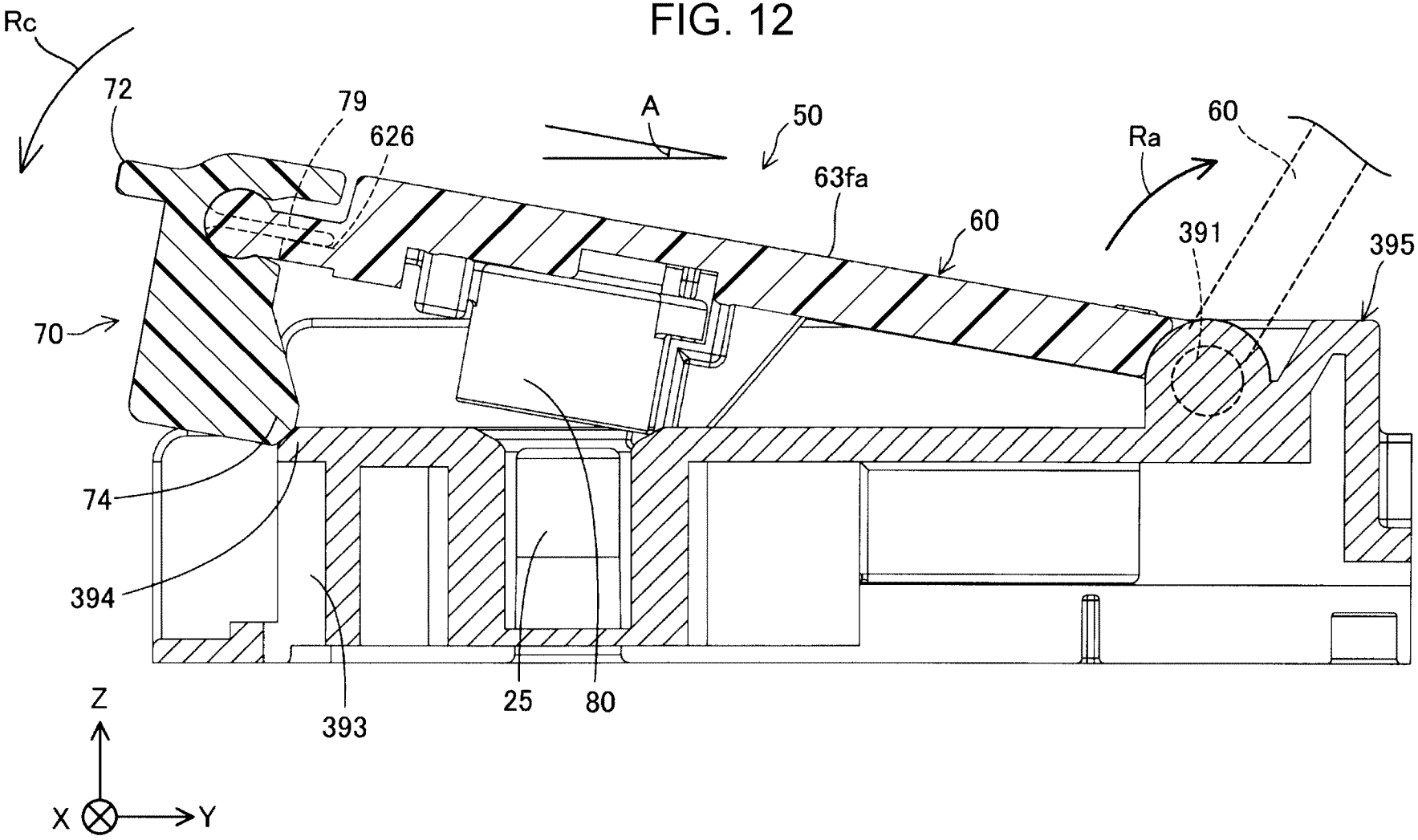
FIG. 12 is a third diagram for illustrating the opening/closing operation of the lever.

FIG. 10 is a first diagram for illustrating an opening/closing operation of the lever 50. FIG. 11 is a second diagram for illustrating the opening/closing operation of the lever 50. FIG. 12 is a third diagram for illustrating the opening/closing operation of the lever 50. FIG. 10 is a partial cross-sectional view taken along line X-X in FIG. 4. FIGS. 11 and 12 are cross-sectional views corresponding to the partial cross-sectional view in FIG. 10. FIG. 10 is a drawing of the lever 50 in the closed state, and FIG. 11 is a drawing of the lever 50 in the course of transitioning from the closed state to the open state. FIG. 12 is a diagram of the lever 50 when in the open state.

As illustrated in FIG. 10, when removing the sealing plug 80 from the liquid filling port 25 and filling the liquid, the user holds the holding portion 72 and pivots the lever 50 about the apparatus-side pivot shaft 391, serving as the fulcrum, in the direction of the arrow Ra. Note that a restriction portion 394 of the engagement portion 393 is located on a motion trajectory Tr of the engaged portion 74 about the apparatus-side pivot shaft 391 when the lever 50 is transitioning from the closed state to the open state. The restriction portion 394 is an upper wall of the engagement portion 393, which is the recessed portion, on the +Z direction side. In a state in which the engaged portion 74 is abutted against the restriction portion 394 of the engagement portion 393, as illustrated in FIG. 11, when the user further operates the holding portion 72 and pivots the lever 50 in the arrow Ra direction, the second member 70 pivots, relative to the first member 60, about the lever-side pivot shaft 621, serving as a fulcrum, in the direction indicated by an arrow Rb. With the pivoting of the second member 70, the engaged portion 74 moves in a direction away from the restriction portion 394, in other words, the motion trajectory Tr of the engaged portion 74 is deviated from the area where the restriction portion 394 is located; accordingly, the restriction on the movement of the engaged portion 74 restricted by the restriction portion 394 is released. When the second member 70 is pivoted relative to the first member 60, the elastic portion 79 receiving external force from the pedestal portion 626 becomes elastically deformed. When pivoting of the second member 70 relative to the first member 60 proceeds further to a certain extent, the abutting portion 76 abuts against the coupling body portion 624. Since further pivoting of the second member 70 can be restricted with the above, the elastic portion 79 can be prevented from exceeding the limit of elasticity and can be prevented from becoming damaged.

As illustrated in FIG. 12, when the engaged portion 74 moves to the +Z direction side with respect to the restriction portion 394, there will be no external force from the pedestal portion 626 applied to the elastic portion 79 and the elastic portion 79 will return to its original shape. In other words, the second member 70 will be, relative to the first member 60, pivoted in the direction of an arrow Rc with the force returning the elastic portion 79 to its original shape. In other words, with the elastic portion 79, the position of the second member 70 with respect to the first member 60 can be easily returned to the position when in the unloaded state. The direction of the arrow Rc is opposite to the direction of the arrow Rb. By opening the lever 50 and increasing an open angle A from the state illustrated in FIG. 12, the liquid filling port 25 not being covered by the lever 50 becomes exposed. With the above, the user can fill the liquid from the liquid container 11 through the liquid filling port 25. Note that the open angle A indicates the degree in which the lever 50 is open from the closed state of the lever 50 when in the unloaded state. For example, when in the unloaded state, the open angle A of the lever 50 in the closed state is zero degrees, and the open angle A becomes larger as the opening of the lever 50 becomes larger.

Furthermore, in the state illustrated in FIG. 12 in which the engaged portion 74 is positioned on the +Z direction side with respect to the restriction portion 394, when the user let go of the holding portion 72, due to the elastic portion 79, the position of the second member 70 relative to the first member 60 returns to the position when in the unloaded state; accordingly, the restriction portion 394 and the engaged portion 74 become abutted against each other. With the above, the open angle A of the lever 50 illustrated in FIG. 12 is maintained at a constant angle. From the state illustrated in FIG. 12, for example, by pushing down an end portion of the first member 60 on the −Y direction side towards the −Z direction, the second member 70 is pivoted relative to the first member 60 and the engaged portion 74 moves over the restriction portion 394 and moves towards the −Z direction side. With the above, the engaged portion 74 reaches the inside of the engagement portion 393 and, accordingly, the lever 50 is set to the closed state.

Figure 13:
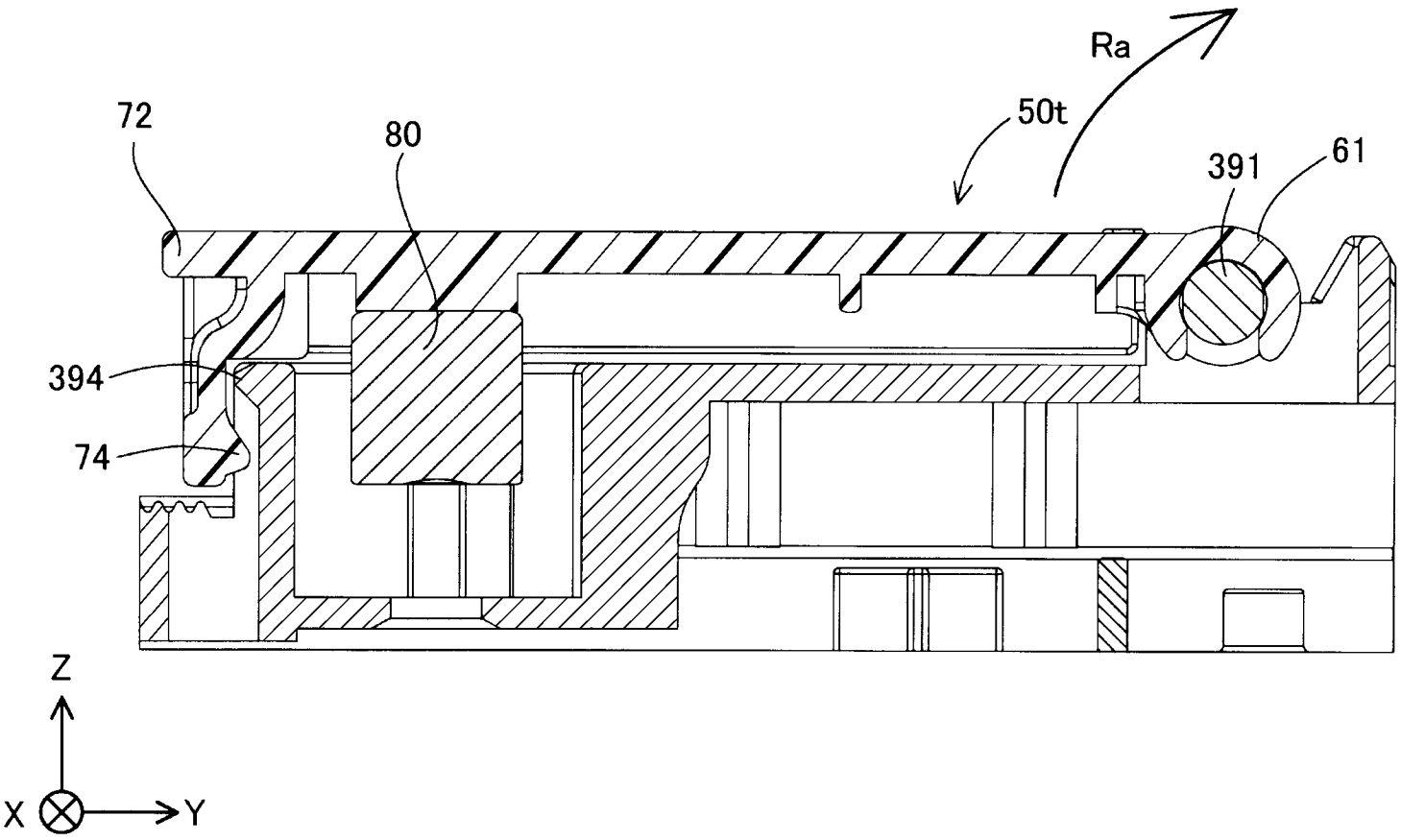
FIG. 13 is a diagram for illustrating a lever of a reference example.
Figure 14:
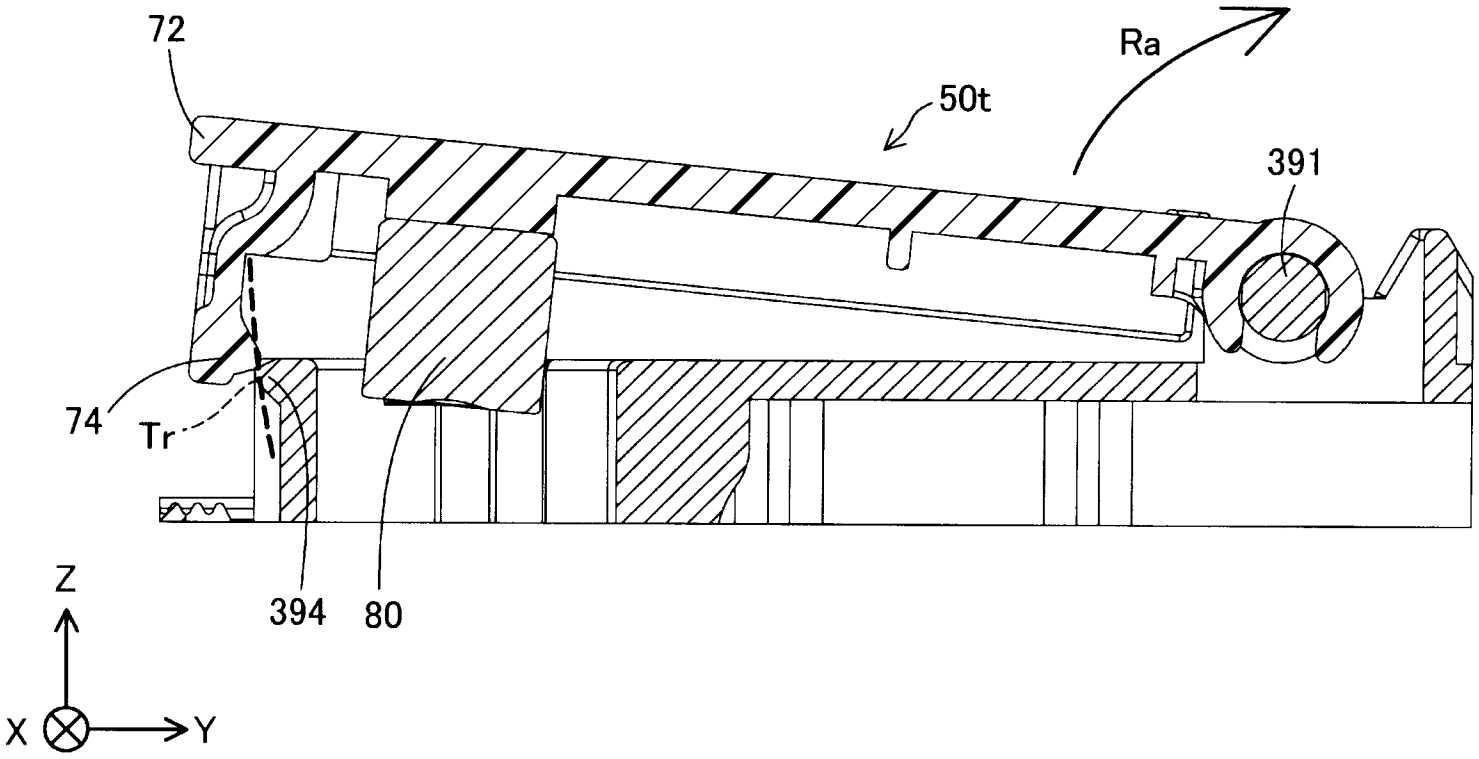
FIG. 14 is a diagram for illustrating a process of opening the lever of the reference example.

FIG. 13 is a diagram for illustrating a lever 50*t* of a reference example. FIG. 14 is a diagram for illustrating a process of opening the lever 50*t* of the reference example. The lever 50*t* is different from the lever 50 of the first exemplary embodiment in that the first member 60 and the second member 70 are not separately configured in a pivotable manner but are configured in an integral manner.

As illustrated in FIG. 14, during an opening operation of the lever 50*t* from the closed state to the open state, the restriction portion 394 of the engagement portion 393 is located on the motion trajectory Tr of the engaged portion 74 about the apparatus-side pivot shaft 391. Accordingly, the engaged portion 74 becomes caught by the restriction portion 394 during the opening operation. In the above state, with the user pivoting the lever 50*t* in the direction of the arrow Ra by applying a stronger force to the holding portion 72 in the pivot direction, as illustrated in FIG. 14, the engaged portion 74 moves above the restriction portion 394 while abutting against the restriction portion 394. In so doing, since force in the +Z direction is applied to the restriction portion 394 from the engaged portion 74, a portion of the carriage 20 on the −Y direction side is lifted towards the +Z direction side. Furthermore, when the engaged portion 74 moving over the restriction portion 394 moves above the restriction portion 394, the carriage 20 moves to the original position with its own weight, in other words, the carriage 20 moves towards the −Z direction side by the lifted amount. In so doing, an impact may be applied to the carriage 20 and air may enter the liquid ejecting head 21 from the outside. In a case in which air has entered the liquid ejecting head 21, when an operation of ejecting the liquid from the liquid ejecting head 21 is performed, a phenomenon in which the liquid is not ejected through the nozzles of the liquid ejecting head 21 or a so-called nozzle skip may occur.

Conversely, according to the first exemplary embodiment described above, as illustrated in FIG. 11, in addition to the first member 60 being pivotable relative to the apparatus body 395, the second member 70 is pivotable relative to the first member 60; accordingly, the impact caused when detaching the sealing plug 80 from the liquid filling port 25 can be relieved. In other words, when the user applies a certain large force to the second member 70 during the operation of opening the lever 50, since the second member 70 pivots relative to the first member 60, the force applied to the second member 70 can be suppressed from being transmitted directly to the first member 60 on which the sealing plug 80 is provided. With the above, since the sealing plug 80 can be suppressed from being vigorously detached from the liquid filling port 25, the liquid can be suppressed from scattering around the liquid filling port 25 when the sealing plug 80 is detached from the liquid filling port 25.

Furthermore, as illustrated in FIGS. 10 and 11, according to the first exemplary embodiment described above, when detaching the sealing plug 80 from the liquid filling port 25, the second member 70 pivots relative to the first member 60; accordingly, the engaged portion 74 is moved in a direction away from the restriction portion 394 and the motion trajectory Tr of the engaged portion 74 is deviated from the range where the restriction portion 394 is positioned. With the above, the impact applied to the restriction portion 394 from the engaged portion 74 can be relieved; accordingly, the possibility of the carriage 20 being lifted can be reduced. With the above, the impact applied to the carriage 20 and the liquid ejecting head 21 can be relieved; accordingly, air entering the liquid ejecting head 21 due to the impact can be suppressed. Accordingly, the possibility of the liquid not being ejected during the operation of ejecting the liquid from the liquid ejecting head 21 can be reduced. Furthermore, according to the first exemplary embodiment described above, the lever 50 includes the holding portion 72; accordingly, the user can easily hold the lever 50 and the operability of the lever 50 can be improved.

B. Second Exemplary Embodiment

Figure 15:
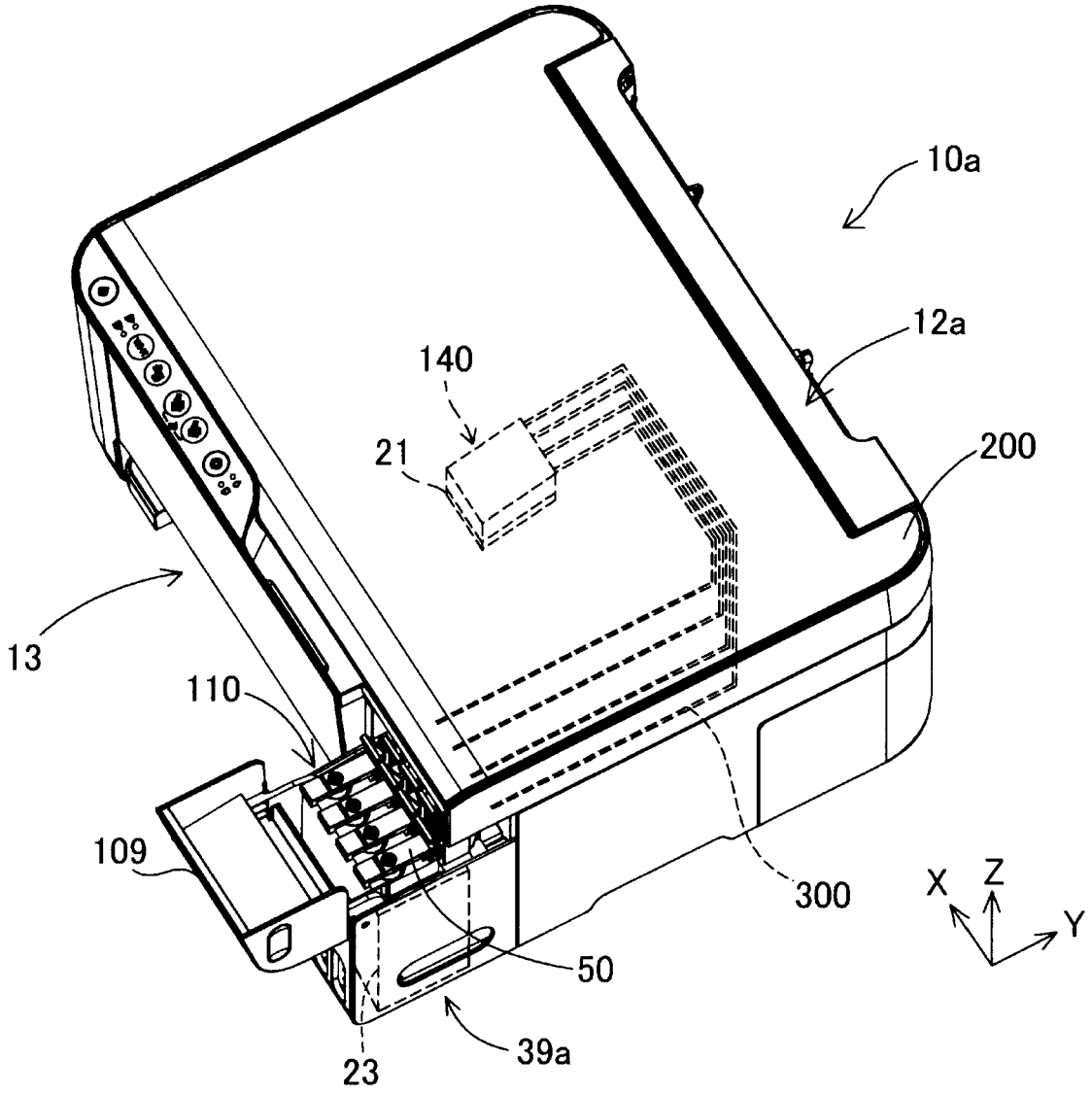
FIG. 15 is a schematic view illustrating a liquid ejecting system of a second exemplary embodiment.

FIG. 15 is a schematic view illustrating a liquid ejecting system 10*a* of a second exemplary embodiment. A main difference between the liquid ejecting system 10 of the first exemplary embodiment illustrated in FIG. 1 and the liquid ejecting system 10*a* is that a liquid ejecting apparatus 12*a* of the liquid ejecting system 10*a* is an off-carriage printer. In the second exemplary embodiment, configurations that are similar to those of the first exemplary embodiment will be denoted with the same reference numerals and description thereof will be omitted as appropriate.

The liquid ejecting system 10*a* includes the liquid ejecting apparatus 12*a* and the liquid containers (not shown). The liquid containers are the same as the liquid containers 11 of the first exemplary embodiment. The liquid ejecting apparatus 12*a* includes a housing 200, a carriage 140 disposed inside the housing 200, a liquid storage apparatus 39*a*, and liquid supply paths 300. The liquid ejecting head 21 is mounted in the carriage 140. Similar to the first exemplary embodiment, the carriage 140 reciprocates in the X direction during a printing operation, for example.

The liquid storage apparatus 39*a* includes an apparatus body 110, a cover 109, the plurality of liquid storage containers 23, and the plurality of levers 50 corresponding to the plurality of liquid storage containers 23. The apparatus body 110 is provided integrally with the housing 200 and houses the plurality of liquid storage containers 23. The cover 109 is configured to open/close, and is opened in a manner illustrated in FIG. 15 when the user fills the liquid into the liquid storage container 23. After opening the cover 109 and exposing the levers 50, the user opens the lever 50 to fill the liquid from a liquid container through the liquid filling port of the liquid storage container 23. Similar to the first exemplary embodiment, the liquid storage apparatus 39*a* includes the apparatus-side pivot shaft 391 (not shown) and the engagement portions 393 (not shown) that engage with the second member 70.

The liquid supply path 300 is provided in a plural number so as to correspond to the plurality of liquid storage containers 23. The liquid supply paths 300 are tubes that couple the liquid storage containers 23 of the liquid storage apparatus 39*a* and sub tanks mounted in the carriage 140 to each other. The sub tanks mounted in the carriage 140 are in communication with the liquid ejecting head 21. In other words, the liquid supply paths 300 supply liquids from the liquid storage apparatus 39*a* to the liquid ejecting head 21.

To the point that the second exemplary embodiment described above has a similar configuration as that of the first exemplary embodiment described above, the second exemplary embodiment obtains a similar effect to that of the first exemplary embodiment. For example, similar to the first exemplary embodiment, in the second exemplary embodiment, in addition to the first member 60 being pivotable relative to the apparatus body 110, since the second member 70 is pivotable relative to the first member 60, the impact when the sealing plug 80 is detached from the liquid filling port 25 can be relieved. With the above, since the sealing plug 80 can be suppressed from being vigorously detached from the liquid filling port 25, the liquid can be suppressed from scattering around the liquid filling port 25 when the sealing plug 80 is detached from the liquid filling port 25. Furthermore, in the second exemplary embodiment described above, since the liquid storage apparatus 39*a* is provided at a location that is different from that of the carriage 20, the possibility of an impact being applied to the carriage 20 when performing the opening/closing operation of the lever 50 can be reduced further.

C. Other Exemplary Embodiments

C-1. First Other Exemplary Embodiment

In each of the exemplary embodiments described above, the liquid ejecting apparatuses 12 and 12*a* may be provided with a detection mechanism that detects whether the lever 50 is in the open state or in the closed state. For example, a sensor configured to detect a load applied from the outside is used as the detection mechanism. In the first exemplary embodiment, the above sensor is, in the Z direction, disposed in an area on the +Z direction side with respect to the lever 50 in the closed state and in an area where the second member 70 in the open state illustrated in FIG. 12 is located. When detecting the open state of the lever 50, the carriage 20 is moved in the X direction. When the lever 50 is in the closed state, the lever 50 does not come in contact with the sensor; accordingly, no load will be applied to the sensor and the closed state can be detected. On the other hand, when the lever is in the open state illustrated in FIG. 12, the first member 60 of the lever 50 comes in contact with the sensor; accordingly, the open state can be detected. Note that as illustrated in FIG. 12, a state in which the engaged portion 74 is detached from the engagement portion 393 and in which the lever 50 is in the open state can be maintained by abutting the engaged portion 74 against the restriction portion 394. With the above, as illustrated in FIG. 12, a large open angle A of the lever 50 while the lever 50 is transitioned from the closed state to the open state can be maintained; accordingly, the detection accuracy of the detection mechanism can be improved.

C-2. Second Other Exemplary Embodiment

In the exemplary embodiments described above, the opening/closing mechanism including the lever 50 and the engagement portion 393 including the restriction portion 394 is used to seal the liquid filling port 25; however, the opening/closing mechanism may be used for other purposes. For example, an opening/closing lever mechanism that opens/closes various flow paths through which the liquid and gas flow may be used as the opening/closing mechanism. In such a case, the opening/closing lever mechanism further includes a cam disposed on the first attaching portion 61 side of the lever 50, and a slider member that is interlocked with the cam. The slider member is configured to bring the flow path to a closed state by squashing the flow path configured of a tube from the outside. For example, in a first state illustrated in FIG. 10 in which the engaged portions 74 are engaged with the engagement portion 393, the flow path is closed by the slider member. On the other hand, when the engagement between the engaged portions 74 and the engagement portion 393 is canceled and the open angle A becomes large, the slider member becomes displaced and the flow path is opened. Even when the technique of the present disclosure is used as the opening/closing lever mechanism, the detection accuracy of the sensor detecting the open/closed state of the opening/closing lever mechanism can be improved by, for example, the open angle A. In other words, after the engaged portions 74 have temporarily become detached from the engagement portion 393, a certain open angle A as illustrated in FIG. 12 can be maintained while in the unloaded state; accordingly, the sensor is capable of accurately detecting the open/closed state, in particular, the sensor is capable of accurately detecting the state illustrated in FIG. 12.

C-3. Third Other Exemplary Embodiment

In the exemplary embodiments described above, the elastic portion 79 is not limited to a flat spring and may be any component that generates force returning to the original position when the second member 70 is pivoted relative to the first member 60. For example, the elastic portion 79 may be torsion spring.

C-4. Fourth Other Exemplary Embodiment

The present disclosure is not limited to an ink jet printer and may be applied to any liquid ejecting apparatus that ejects a liquid other than ink. For example, the present disclosure can be applied to various liquid ejecting apparatuses as follows:

(1) Image recording apparatuses such as a facsimile machine,
(2) Coloring material ejecting apparatuses used in manufacturing a color filter for an image display apparatus such as a liquid crystal display,
(3) Electrode material ejecting apparatuses used to form electrodes of an organic electroluminescence (EL) display, a surface emitting display (field emission display or FED), and the like,
(4) Consumables consuming apparatuses that eject a liquid containing bio organic matter used in manufacturing biochips,
(5) A sample ejecting apparatus serving as a precision pipette,
(6) A lubricating oil ejecting apparatus,
(7) A liquid resin ejecting apparatus,
(8) A liquid ejecting apparatus that ejects lubricating oil in a pinpoint manner onto a precision instrument such as a clock or a camera,
(9) A liquid ejecting apparatus that ejects a transparent liquid resin such as an ultraviolet curing liquid resin on a substrate to form a hemispherical microlens (an optical lens) used in optical communication elements and the like,
(10) A liquid ejecting apparatus that ejects an acidic or an alkaline etching solution to perform etching on a substrate and the like, and
(11) A liquid ejecting apparatus that includes a head that discharges any other minute droplets.

Note that a "droplet" is in a liquid form discharged from the liquid ejecting apparatus and includes a granular shape, a tear shape, or a shape with a threadlike trail. Furthermore, a "liquid" herein includes any material that can be ejected by the liquid ejecting apparatus. For example, any material in a liquid state is sufficient as the "liquid" and the liquid includes a material in a liquid state with high or low viscosity, sol, gel water, and other inorganic solvents, an organic solvent, a solution, liquid resin, liquid metal, and metallic melt. Furthermore, not just liquid as a state of matter, the "liquid" includes particles of functional material including a solid body such as pigment or metal particles that are dissolved, dispersed, or mixed in a solvent. Furthermore, a representative example of the liquid includes ink, liquid crystal, and others that have been described in the exemplary embodiments described above. Note that ink includes a variety of liquid compositions such as a general aqueous ink, solvent ink, and gel ink, and a hot melt ink.

D. Other Configurations

The present disclosure is not limited to the exemplary embodiments described above and may be implemented through various configurations that do not depart from the scope of the disclosure. For example, the present disclosure can be implemented through the following configurations. The technical features of the exemplary embodiments described above that correspond to the technical features of the configurations described below may be appropriately replaced or combined in order to overcome a portion or all of the issues that the present disclosure is to overcome, or in order to achieve a portion or all of the effects that the present disclosure is to provide. Furthermore, the technical features that are not described in the present specification as an essential feature can be omitted as appropriate.

(1) According to a configuration of the present disclosure, a lever provided in a liquid storage apparatus that includes a liquid filling port is provided. The lever includes a first member that is pivotable relative to an apparatus body of the liquid storage apparatus, a second member that is pivotable relative to the first member, and a flexible sealing plug that seals the liquid filling port, the first member including, a lever body on which the sealing plug is mounted, a first attaching portion provided on a first end of the lever body, the first attaching portion configured to pivotably engage with the apparatus body, and a second attaching portion provided on a second end of the lever body, the second attaching portion configured to pivotably engage with the second member.

According to such a configuration, in addition to the first member being pivotable relative to the apparatus body, the second member is pivotable relative to the first member; accordingly, the impact caused when detaching the sealing plug from the liquid filling port can be relieved. With the above, the liquid can be suppressed from scattering around the liquid filling port when the sealing plug is detached from the liquid filling port.

(2) In the configuration described above, the second attaching portion may include a lever-side pivot shaft with which the second member pivotably engages, and a coupling portion that couples the lever-side pivot shaft and the lever body to each other, and the second member may include an elastic portion that is elastically deformed by external force applied from the coupling portion when the second member is pivoted relative to the first member.

Since such a configuration includes the elastic portion, the position of the second member with respect to the first member can be easily returned to the position of the unloaded state with the force of the elastic portion returning to its original shape.

(3) In the configuration described above, the elastic portion may be a flat spring.

According to such a configuration, the elastic portion can be formed easily with the flat spring.

(4) In the configuration described above, the second member may include an abutting portion that opposes the coupling portion, the abutting portion restricting pivoting of the second member when the second member is pivoted relative to the first member by abutting against the coupling portion.

According to such a configuration, since pivoting of the second member can be restricted with the abutting portion, the elastic portion can be prevented from exceeding the limit of elasticity and can be prevented from becoming damaged.

(5) In the configuration described above, the second member may include a holding portion that is held when the lever is operated.

Since such a configuration includes the holding portion, the operability of the lever can be improved.

(6) In the configuration described above, the holding portion and the abutting portion may be disposed at different height positions, and the second member may include an inclined portion that couples the holding portion and the abutting portion to each other through formation of an inclination.

Since such a configuration includes the inclined portion, compared to when the lever does not include the inclined portion, the adhesion between a finger of the user, and the holding portion and the inclined portion can be increased when the user holds the inclined portion together with the holding portion. In other words, it will be easier for the user to hold the holding portion.

(7) In the configuration described above, a surface of the abutting portion on a side opposite a side on which the coupling portion is positioned, and a surface of the lever body on a side opposite a side on which the sealing plug is positioned may be located on a same plane.

According to such a configuration, occurrence of unevenness in the entire lever can be reduced.

(8) According to another configuration of the present disclosure, a liquid storage apparatus is provided. The liquid storage apparatus includes the lever of the configuration described above, and an apparatus-side pivot shaft that pivotably engages with the first attaching portion.

According to such a configuration, a liquid storage apparatus that can suppress the liquid from scattering around the liquid filling port when the sealing plug is detached from the liquid filling port can be provided.

(9) The configuration described above may further include an engagement portion that engages with the second member. The second member may include an engaged portion that maintains a closed state of the lever by engaging with the engagement portion.

According to such a configuration, the closed state of the lever can be maintained using the engagement portion and the engaged portion.

(10) In the configuration described above, the liquid storage container that includes the liquid filling port, the liquid storage container storing a liquid therein, in which a color of the liquid stored in the liquid storage container and a color of at least a portion of the second member are equivalent to each other.

According to such a configuration, the user will be able to easily distinguish the color of the liquid stored in the liquid storage container to which the liquid is to be filled.

(11) According to another configuration of the present disclosure, a liquid ejecting apparatus is provided. The liquid ejecting apparatus includes the liquid storage apparatus of the configuration described above, a liquid ejecting head, and a carriage on which the liquid storage apparatus and the liquid ejecting head are mounted.

According to such a configuration, since the impact when detaching the sealing plug from the liquid filling port can be relieved, the impact applied to the carriage and the liquid ejecting head can be relieved. With the above, since entering of air into the liquid ejecting head from the outside due to the impact can be suppressed, the possibility of the liquid not being ejected during the operation of ejecting the liquid from the liquid ejecting head can be reduced.

(12) According to another configuration of the present disclosure, a liquid ejecting apparatus is provided. The liquid ejecting apparatus includes the liquid storage apparatus of the configuration described above, a liquid ejecting head, and a liquid supply path that supplies a liquid to the liquid ejecting head from the liquid storage apparatus.

According to such a configuration, a liquid ejecting apparatus that can suppress the liquid from scattering around the liquid filling port when the sealing plug is detached from the liquid filling port can be provided.

Other than the lever, the liquid storage apparatus, and the liquid ejecting apparatus described above, the present disclosure can be provided as a method of manufacturing the lever, and a configuration of a liquid ejecting system and the like that includes the liquid ejecting apparatus and the liquid container.

What is claimed is:

1. A lever provided in a liquid storage apparatus that has a liquid filling port, the lever comprising:

a first member that is pivotable relative to an apparatus body of the liquid storage apparatus;

a second member that is pivotable relative to the first member; and a flexible sealing plug that seals the liquid filling port, the first member including, a lever body on which the sealing plug is mounted, a first attaching portion provided on a first end of the lever body, the first attaching portion configured to pivotably engage with the apparatus body, and a second attaching portion provided on a second end of the lever body, the second attaching portion configured to pivotably engage with the second member.

2. The lever according to claim 1, wherein the second attaching portion includes a lever-side pivot shaft with which the second member pivotably engages, and a coupling portion that couples the lever-side pivot shaft and the lever body to each other, and the second member includes an elastic portion that is elastically deformed by external force applied from the coupling portion when the second member is pivoted relative to the first member.

3. The lever according to claim 2, wherein the elastic portion is a flat spring.

4. The lever according to claim 2, wherein the second member includes an abutting portion that opposes the coupling portion, the abutting portion restricting pivoting of the second member when the second member is pivoted relative to the first member by abutting against the coupling portion.

5. The lever according to claim 4, wherein the holding portion and the abutting portion are disposed at different height positions, and the second member includes an inclined portion that couples the holding portion and the abutting portion to each other through formation of an inclination.

6. The lever according to claim 4, wherein a surface of the abutting portion on a side opposite a side on which the coupling portion is positioned, and a surface of the lever body on a side opposite a side on which the sealing plug is positioned are located on a same plane.

7. The lever according to claim 1, wherein the second member includes a holding portion that is held when the lever is operated.

8. A liquid storage apparatus comprising:

the lever according to claim 1; and an apparatus-side pivot shaft that pivotably engages with the first attaching portion.

9. The liquid storage apparatus according to claim 8, further comprising:

an engagement portion that engages with the second member, wherein the second member includes an engaged portion that maintains a closed state of the lever by engaging with the engagement portion.

10. The liquid storage apparatus according to claim 8, further comprising:

a liquid storage container that includes the liquid filling port, the liquid storage container storing a liquid therein, wherein a color of the liquid stored in the liquid storage container and a color of at least a portion of the second member are equivalent to each other.

11. A liquid ejecting apparatus comprising:

the liquid storage apparatus according to claim 8;

a liquid ejecting head; and a carriage on which the liquid storage apparatus and the liquid ejecting head are mounted.

12. A liquid ejecting apparatus comprising:

the liquid storage apparatus according to claim 8;

a liquid ejecting head; and a liquid supply path that supplies a liquid to the liquid ejecting head from the liquid storage apparatus.

* * * * *